US009103034B2

(12) United States Patent
Bell et al.

(10) Patent No.: US 9,103,034 B2
(45) Date of Patent: Aug. 11, 2015

(54) METHOD OF COATING A METALLIC ARTICLE WITH A SURFACE OF TAILORED WETTABILITY

(75) Inventors: Steven Ernest John Bell, Belfast (GB); Iain Alexander Larmour, Bangor (GB); Graham Charles Saunders, Belfast (GB)

(73) Assignee: The Queen's University of Belfast (GB)

( * ) Notice: Subject to any disclaimer, the term of this patent is extended or adjusted under 35 U.S.C. 154(b) by 850 days.

(21) Appl. No.: 12/442,034

(22) PCT Filed: Sep. 17, 2007

(86) PCT No.: PCT/GB2007/003508

§ 371 (c)(1), (2), (4) Date: Feb. 12, 2010

(87) PCT Pub. No.: WO2008/035045

PCT Pub. Date: Mar. 27, 2008

(65) Prior Publication Data

US 2010/0143741 A1 Jun. 10, 2010

(30) Foreign Application Priority Data

Sep. 20, 2006 (GB) ..... 0618460.0

(51) Int. Cl.
*B05D 5/02* (2006.01)
*B05D 5/08* (2006.01)
(Continued)

(52) U.S. Cl.
CPC . *C23C 26/00* (2013.01); *B05D 5/02* (2013.01); *B05D 5/08* (2013.01); *C23C 18/54* (2013.01);
(Continued)

(58) Field of Classification Search
CPC ..... B05D 5/02; B05D 5/08
See application file for complete search history.

(56) References Cited

U.S. PATENT DOCUMENTS 3,922,431 A * 11/1975 Radmacher et al. ..... 428/327
4,104,197 A 8/1978 Heffler
(Continued)

FOREIGN PATENT DOCUMENTS

EP 1568800 A1 8/2005
JP 07165433 A 6/1995
(Continued)

OTHER PUBLICATIONS

Bain et al., Formation of Monolayer Films by the Spontaneous Assembly of Organic Thiols from Solution onto Gold, JACS, 1989, 111, 321-335.*
(Continued)

*Primary Examiner* — James M Mellott
(74) *Attorney, Agent, or Firm* — The Webb Law Firm

(57) ABSTRACT

A method of coating a metallic article having an at least part-metallic surface comprising a first metal, with a surface having a pre-determined wettability, the method at least comprising the steps of: (a) coating at least a part of the metallic article with a layer of a second metal to provide a metal-metal bonded surface, said surface being rough either prior to or because of step (a); and (b) contacting the metal-metal bonded surface of step (a) with a material to provide the surface having the pre-determined wettability. The first metal may be one or more of the group comprising: iron, zinc, copper, tin, nickel and aluminum, and alloys thereof including steel, brass, bronze and nitinol for example. Preferably, the second metal is coated onto the first metal using electroless Galvanic deposition. The nature of the coated metallic article is non-limiting, as the ability of the present invention is to provide a tailored surface with a pre-determined wettability thereon, including superhydrophobic and superhydrophilic wettability. This allows the invention to be capable of application to a wide range of metal types used in different fields.

17 Claims, 7 Drawing Sheets

40 mesh powder SEMs

(51) Int. Cl.

| | |
|---|---|
| ***C23C 26/00*** | (2006.01) |
| ***C23C 18/54*** | (2006.01) |
| ***C23C 28/02*** | (2006.01) |
| ***C23C 30/00*** | (2006.01) |
| ***C25D 7/00*** | (2006.01) |
| ***C23C 28/00*** | (2006.01) |

(52) U.S. Cl.

CPC ..... *C23C 28/00* (2013.01); *C23C 28/021* (2013.01); *C23C 28/023* (2013.01); *C23C 28/025* (2013.01); *C23C 30/00* (2013.01); *C25D 7/00* (2013.01); *Y10T 428/12028* (2015.01); *Y10T 428/12049* (2015.01); *Y10T 428/12472* (2015.01)

(56) References Cited

U.S. PATENT DOCUMENTS

| | | | | |
|---|---|---|---|---|
| 4,506,037 | A | 3/1985 | Suzuki et al. | |
| 5,603,815 | A | 2/1997 | Lashmore et al. | |
| 6,277,489 | B1 * | 8/2001 | Abbott et al. | 506/15 |
| 7,285,331 | B1 | 10/2007 | Reihs et al. | |
| 2006/0110537 | A1 | 5/2006 | Huang et al. | |

FOREIGN PATENT DOCUMENTS

| | | | |
|---|---|---|---|
| JP | 09278598 | A | 10/1997 |
| JP | 11097030 | A | 4/1999 |
| JP | 2002256466 | A | 9/2002 |
| JP | 2002533560 | A | 10/2002 |
| JP | 2006225744 | A | 8/2006 |
| RU | 2126311 | C1 | 2/1999 |
| RU | 2192334 | C2 | 11/2002 |
| WO | 9526245 | A1 | 10/1995 |
| WO | 9800256 | A1 | 1/1998 |
| WO | 2008/035045 | A2 | 3/2008 |

OTHER PUBLICATIONS

Kobayashi et al., Deposition of Silver Nanoparticles on Silica Spheres Steps in Electroless Plating; Chem. Mater., 2001, 13, 1630-1633.*

Che Wan Zanariah Bte Che Wan Ngah, Studies on formulations for gold alloy plating bath to produce different shades of electrodeposits, Ph.D. Thesis, Jun. 2004.*

Gao L, McCarthy TJ. A perfectly hydrophobic surface (thetaA/thetaR=180 degrees /180 degrees). J Am Chem Soc. Jul. 19, 2006; 128(28):9052-3.

Moon J, Kang T, Oh S, Hong S, Yi J. In situ sensing of metal ion adsorption to a thiolated surface using surface plasmon resonance spectroscopy. J Colloid Interface Sci. Jun. 15, 2006;298(2):543-9. Epub Feb 3, 2006. (Cited in ISR/WO).

Pang G, Dale JD, Kwok DY. An integrated study of dropwise condensation heat transfer on self-assembled organic surfaces through Fourier transform infra-red spectroscopy and ellipsometry. International Journal of Heat and Mass Transfer. vol. 48, Issue 2, Jan. 2005, pp. 307-316. (Cited in ISR/WO).

"Superhydrophobic surfaces" by Minglin MA, Randal M. Hill, published in "Current Opinion in Colloid & Interface Science" 11 (2006), pp. 193-202.

"Superhydrophobic surfaces: from structural control to functional application" by Xi Zhang, Feng Shi, Yugui Jiang, Zhigiang Wang, published in "Journal of Materials Chemistry" 18, (2008), pp. 621-633.

Iain A. Larmour et al, "Sheets of Large Superhydrophobic Metal Particles Self Assembled on Water by the Cheerios Effect", Angew. Chem. Int. Ed. 2008, 47, pp. 5043-5045.

Adam Steele et al., "Inherently Superoleophobic Nanocomposite Coatings by Spray Atomization", Nano Lett., 2009, 9(1), 501-505 DOI: 10.1021/n18037272, Publication Date (Web): Dec. 19, 2008 (6 pgs).

* cited by examiner

METHOD OF COATING A METALLIC ARTICLE WITH A SURFACE OF TAILORED WETTABILITY

This application is a National Stage entry of International Application No. PCT/GB2007/003508 filed on 17 Sep. 2007 and claims the benefit under 35 U.S.C. §119 of Great Britain patent application 0618460.0 filed on 20 Sep. 2006, both of which are incorporated by reference in their entirety.

The present invention relates to a method of coating a metallic article with a surface to provide tailored wettability which can range from superhydrophobic to superhydrophilic for water and aqueous solutions and from completely non-wetting to fully wetting for other liquids. The present invention also relates to so-formed metallic articles and their use.

The extent to which a liquid wets a surface is typically defined by the 'contact angle' which is the angle that a drop of liquid makes with the surface.

Due to its special importance much research has concentrated on water as the liquid, and this has led to the use of the term 'superhydrophobic' for surfaces which give contact angles larger than 150° with water. For a perfectly hydrophobic surface the contact angle should be 180°. A water drop applied to such a surface would roll freely, with apparently no friction.

There have been a wide range of approaches to the synthesis of superhydrophobic surfaces, and these include: the use of polyelectrolyte multilayers, sol-gels, self-assembly, plasma treatment, nanosphere lithography, carbon nanotube forests, raspberry-like particles, silica-based surfaces and chemical etching of glass and metal.

Due to difficulties in accurate visualization of the contact between liquid and surface, contact angle measurements are not straightforward, particularly at the extremes of the contact angle scale, i.e. 0° and 180°, but one method for preparation of a perfectly hydrophobic ($\theta$=180°) surface has been claimed (L. Gao and T. J. McCarthy, Journal of the American Chemical Society, 2006, vol. 128, 9052-53). However, this method is not generally or industrially applicable as it is limited to silicon, works for only 70% of samples, and involves the use of expensive equipment for an oxygen plasma cleaning step.

It is one object of the present invention to provide a simple method for providing a surface with a tailored wettability for water and other liquids on a metallic article.

It is another object of the present invention to provide a method for providing a surface with a tailored wettability for water and other liquids on a range of metallic surfaces.

It is another object of the present invention to provide a method for providing a surface with a tailored wettability for water and other liquids on a range of metallic articles.

It is another object of the present invention to provide a method for providing a surface with a tailored wettability for water and other liquids on a range of non-metallic substrates coated with a metal.

The present invention provides a method of providing a surface on a metallic article which gives a desired level of wettability.

According to one aspect of the present invention, there is provided a method of coating a metallic article having an at least part-metallic surface comprising a first metal, with a surface having a pre-determined wettability, the method at least comprising the steps of:

(a) coating at least a part of the metallic article with a layer of a second metal to provide a metal-metal bonded surface, said surface being rough either prior to or because of step (a); and (b) contacting the metal-metal bonded surface of step (a) with a material to provide the surface having the pre-determined wettability.

The first metal may be one or more of the group comprising: iron, zinc, copper, tin, nickel and aluminium, and alloys thereof including steel, brass, bronze and nitinol for example.

The coating of at least part of the metallic article with a second metal can be carried out using any known process such as sputtering, any electrochemical method such as electrochemical deposition, a spontaneous redox reaction, or immersion.

Virtually any metal can be sputtered onto the surface of the first metal of the metallic article, especially metals such as gold and silver, and especially where the metallic article is first etched with an acid such as hydrochloric acid. Thus the invention is not limited by the nature of the second metal.

Spontaneous electrochemical deposition methods usually require that the reduction potential of the first metal of the metallic article is more negative than the second metal ion to be deposited and coated on to the metallic article surface. Whether spontaneous or not, such a method requires that the part of the metallic article to be coated is contacted with a solution of second metal ions, which ions are then reduced to the second metal at the surface.

As is known in the art, some electrochemical methods are spontaneous, some need to be driven.

For example, if gold or silver is to be deposited in a spontaneous redox reaction, then suitable first metals for the metallic article to be coated may be one or more of the group comprising: iron, zinc, copper, tin, nickel and aluminium, and alloys thereof including steel, brass, bronze and nitinol. In another example, platinum may be deposited on scandium or zinc.

The metallic article can be any suitable article, material, item or substrate or the like, having at least a part-metallic surface. The metallic article may be in its own right, or a surface or a component, optionally separable or integral, with a larger article or substrate.

In one embodiment of the present invention, the surface of the metallic article is wholly or substantially (generally >50 mass %) metallic. For example, the metallic article could be wholly metal, or at least have a continuous metallic surface. Examples include a metal sheet or a formed metal article, such as a nail, bucket, fork, rod, etc., extending to larger articles such as a metal beam, metal cable, or rail or even larger planar surfaces such as a ship's hull. Another example is one or more of the heat transfer sheets of a heat exchanger. For example, having a superhydrophobic surface on the transfer sheet for a water-based heat exchanger, such as involving steam, reduces or prevents the creation of a continuous condensation layer of the steam on the heat transfer sheet which inhibits continuing heat transfer from the steam to another medium.

Another example of suitable metallic articles are separators or filters, generally intended to allow the passage of one material and prevent the passage of a second material, and in this way be a species-specific barrier material. For example, a superhydrophobic gas-permeable filter could allow the passage of gases such as air therethrough, whilst hindering the passage of water therethrough. In another example, a polar and non-polar liquid mixture such as water and oil or an organic solvent such as hexane could be passed through a filter having at least a part superhydrophobic surface, such that the water is rejected and the organic solvent passes therethrough and is therefore separated from the water.

The present invention is not limited by the use, shape, dimension or purpose of the metallic article. The present invention allows such metallic articles to have a surface with a pre-determined wettability for any liquid (not limited to water).

Suitable metallic articles may be rigid or flexible, or comprise one or more parts which are flexible and one or more parts which are rigid or relatively more rigid than one or more other parts.

In another embodiment of the present invention, the metallic article is a powder. That is, a collection of metal particles being of any size or range of sizes, examples of which include millimeter, sub-millimeter, and particles of micrometer dimension, which can be similarly coated by the present invention.

The powder may be a solid metal powder, whose surface is therefore wholly metallic, or an at least partly, optionally fully, metal-coated powder of another substance such as glass or another ceramic or silicate. A powderous form of metal-coated glass beads is known in the art, and is useable with the present invention.

In another embodiment of the present invention, the metallic article is admixed or embedded in a non-metallic article. Examples include admixing the metallic article such as a metallic powder in a monomer or polymer plastics composition, optionally before forming of a plastics shape, or embedding the metallic article, particularly but not limited to a metallic powder, into the surface of a non-metallic article such as a plastic, for example by rolling or pressing. In one way, the plastic is 'doped' with the metallic article. The metallic article as a powder could also be admixed with one or more powders, particulates of granular materials such as cementitious materials like cement.

According to a further embodiment of the present invention, the metallic article is a substrate which is at least partly, optionally wholly, pre-coated with a third metal to provide the at least part-metallic surface of the metallic article suitable for the method of the present invention. One example is copper-plating a surface, to provide a suitable copper article able to be coated as hereindescribed. Copper can be plated on to many types, designs or arrangements of surfaces and substrates, whether being metallic, non-metallic or a combination of same. This includes ceramics, silicon and even other metal surfaces to which the direct coating with a layer of a second metal (to provide the metal-metal bonded surface of step (a)) may be difficult.

Where the substrate is non-metallic, the third metal becomes the first metal described hereinabove to provide the at least part-metallic surface comprising a first metal.

Thus, the third metal may be any suitable metal based on the properties of the substrate to be covered. Preferably, the third metal is one or more of the group comprising: iron, zinc, copper, tin, tungsten, titanium, nickel and aluminium, and alloys thereof including steel, brass, bronze and nitinol.

The pre-coating of the metallic article with a third metal can be carried out using any known process such as sputtering, any electrochemical method such as electrochemical deposition, a spontaneous redox reaction, or immersion.

Immersing includes any form of dipping either at an ambient or a raised temperature. For example, galvanizing material, generally with zinc, is generally carried out by immersion of the metallic article in a bath of zinc at a temperature generally between 400°-500° C.

Other substrates which could be pre-coated, including but not limited to copper plating, include steels such as stainless steel, metals such as tungsten, aluminium, titanium, and other alloys or substrates such as nitronol, ceramics, silicone, etc.

Some processes for the coating of step (a) will create a rough metal-metal bonded surface suitable for step (b), e.g. many electrochemical processes such as electrochemical deposition.

Processes such as sputtering or evaporative coating generally lay down an even layer of second metal on the metallic article being coated. Thus, where the coating process of step (a) does not inherently create a rough surface, roughening of the relevant part of the surface of the metallic article to be coated, to provide the rough surface for step (b), is required in advance of, i.e. prior to, step (a). Processes for roughening a metallic article surface are also well known in the art, and include chemical methods such as etching, and physical methods such as sand blasting or laser ablation.

The term "rough" as used herein relates to the microstructure of the metal-metal bonded surface (and the original surface of the metallic article where such surface needs to be roughened prior to step (a)). It is known that the wettability of solid surfaces with liquids is governed by the chemical properties and the microstructure of the surface, and the 'roughness' of the microstructure of the surface is known to enhance the wettable properties of a surface, increasing the ability of the present invention to tailor or pre-determine the desired wettability for the liquid concerned.

Preferably, the metal-metal bonded surface (and if necessary the original surface) has a 'double roughness', in the sense of having a first roughness structure on a microscale, for example "clusters', 'stems', 'nodes', or 'flowers' or the like, usually sized between 100 nm and 100 μm, such as 0.15 μm to 1 μm, on which first roughness structure is a second roughness structure, being finer structures such as nanoscale extensions or protuberances of less than 30%, 20%, 10%, 5%, 2% or even 1% or less, of the size of the first roughness structure, such as is typical in a hierarchical lotus-leaf-like structure. The extensions of protuberances of the second roughness could be in the range 10 nm to 500 nm, such as 50 nm to 200 nm. Thus, there is preferably a double roughness to the metal-metal bonded surface for step (a).

The hierarchical double roughness structure of the lotus leaf is by way of illustration only, and the present invention is not limited to the actual shape or design of the first and second roughness structures. Accompanying FIGS. 2*a-d*, 5 and 6 herewith show three different examples of first and second roughness structures. It is the relationship of the second roughness structure being smaller, usually significantly smaller, than the first roughness structure that provides the enhancement effect.

As mentioned hereinabove, some processes for the coating of step (a) will create a rough metal-metal bonded surface suitable for step (b) such as electrochemical deposition or electroless Galvanic deposition. The skilled person is aware that the concentration and timing of the chemical used for the process can affect the roughness created, and thus the wettability of the final surface provided by the invention.

The term "pre-determined wettability" as used herein relates to providing a surface on the metallic article having a minimum or maximum contact angle with a liquid. Where the liquid is water, the terms superhydrophobic and superhydrophilic can be used. A superhydrophobic surface can have a contact angle larger than 150°, preferably more than 160°, 170° or even 175°. For a superhydrophilic surface, the contact angle can be below 5°.

The same contact angle figures can be used for the wettability using other liquids such as organic materials, including solvents. Such liquids include for example hydrocarbons such as oil, petrol, benzene, as well as well known chemical solvents such as DMSO. The same test is used to determine their contact angle with a surface.

Step (b) of the present invention is preferably carried out at ambient pressure and temperature. Step (a) could also be carried out at ambient conditions, or conditions slightly above ambient. A slightly above ambient temperature can be less than 500° C., preferably less than 200° C., and preferably around or less than 100° C.

The present invention can also provide a coated metallic article and method for providing said coated metallic article having two or more different surfaces and/or coatings thereon with the same or different wettability. For example, the present invention can provide a coated metallic article having a first area with a superhydrophobic surface, and a second area either without, within, or for example parallel to the first area, for a superhydrophilic surface, so as to direct, such as channel, water along a pre-determined path across the metallic article. Other arrangements using phobic or philic areas to or for different solvents could provide other patterns on the metallic article adapted to direct or channel different liquids.

The nature of the coated metallic article is non-limiting, as the ability of the present invention is to provide a tailored surface with a pre-determined wettability thereon. This allows the invention to be capable of application to a wide range of metal types used in different fields. By way of example only, the fields can include:

self-cleaning surfaces for use in architectural cladding, roofing materials, coating of the exterior surfaces of automobiles and other forms of transport including aircraft and ships, garden furniture, metallic fencing and gates;

surfaces for use in water environments such as ships to which the non-attachment of other components is desired, e.g. antifouling, or where reduction of contact with corrosive elements in the water, such as salt in sea-water, is desired;

surfaces for use in water environments such as ships where minimization of resistance to movement through the water is desired;

surfaces for use in moist environments such as marine or coastal locations where reduction of contact with corrosive elements in the air, such as salt in sea-water spray or air-borne sea-water, is desired;

preparation of surfaces for biomedical applications e.g. stents, catheters and wound dressings which can reduce or resist microbial infection and biofilm formation;

coating of hollow tubes or conduits to minimize flow resistance in either microfluidic systems or conventional industrial and domestic pipework; and, coating of hollow tubes or conduits to prepare optical waveguides which will conduct visible and uv light and may be used to transmit the light or as sampling systems for spectroscopy.

In general, the present invention provides a method of tailoring the wettability of at least part of the metallic surface of a metallic article to suit the desired interaction thereof with a liquid. One liquid is water, but the present relates to all other liquids, including for example hydrocarbons and other organic compounds, especially solvents. Thus, the present invention also extends to, for example oleophobic and oleophilic surfaces for example.

The present invention provides a method of refining and/or amplifying the contact, such as the contact angle for a drop or droplet, between the liquid and the coated surface of the metallic article. For a liquid such as water, there are the extremes of superhydrophobicity and superhydrophilicity the present invention also provides a method of changing the contact angle to any where between 0° and 180°, thus tailoring the wettability of the surface to the desired requirement.

The metallic article can be partly, substantially or wholly coated with the tailored surface. It is known in the art how to mask or hide a portion of an article not intended to be coated. Masks or other materials such as waxes, which prevent the contacting of the second metal with the part of the metallic article not to be coated, are known in the art. The part-coating could be to create a pattern for the coated metallic article, such as for creating an array of tailored surfaces upon a single metallic article. Alternatively, it may be that a part of the metallic article, which could be seen as a 'complete' section or unit or item, is to be coated and the remainder not so coated.

All part-coating arrangements or patterns are envisaged by the present invention.

Preferably, the method provides either a superhydrophobic or a superhydrophilic surface on a metallic article, wherein in step (b), the metal-metal bonded surface of step (a) is contacted with hydrophobic material to prepare a superhydrophobic surface, or a hydrophilic material to provide a superhydrophilic surface.

For providing a superhydrophobic surface, the material of step (b) could be one or more of the group comprising: thiols, nitriles, alkylamines, arylamines, phosphines, pyridines, pyrroles, and thiophenes.

Particularly suitable hydrophobic materials for step (b) include: Alkylthiols; Polyfluoroalkylthiols; Perfluoroalkylthiols; Arylthiols; Polyfluoroarylthiols; Perfluoroarylthiols; Alkylnitriles; Polyfluoroalkylnitriles; Perfiouroalkylnitriles Arylnitriles; Polyfluoroarylnitriles; Perfluoroarylnitriles; Alkylamines Polyfluoroalkylamines; Dialkylamines; Polyfluorodialkylamines; Trialkylamines Polyfluorotrialkylamines; Arylamines; Polyfluoroarylamines; Perfluoroarylamines Diarylamines; Polyfluorodiarylamines; Perfluorodiarylamines; Triarylamines Polyfluorotriarylamines; Mixed alkyl/arylamines; Mixed polyfluoro-alkyl/arylamines; Pyridine and pyridine derivatives; Pyrrole and pyrrole derivatives; Thiophene and thiophene derivatives; Alkylphosphines; Polyfluoroalkylphosphines; Dialkylphosphines; Polyfluorodialkylphosphines Trialkylphosphines; Polyfluorotrialkylphosphines; Arylphosphines; Polyfluoroarylphosphines; Perfluoroarylphopshines; Diarylphosphines; Polyfluorodiarylphosphines; Perfluorodiarylphosphines; Triarylphosphines; Polyfluorotriarylphosphines; Mixed alkyl/arylphosphines; and Mixed polyfluoroalkyl/arylphosphines.

Suitable hydrophilic materials for step (b) include:

Mercaptoalcohols; Mercaptophenols

Aminoalcohols; Aminophenols

Nitriloalcohols; Nitrilophenols

Nitriloamines; Aminophosphines

Hydroxyalkylpyridines; Hydroxyarylpyridines

Pyridine and pyridine derivatives; Pyrrole and pyrrole derivatives; and

Thiophene and thiophene derivatives.

Chemicals and compounds having some ability to change the wettability of a surface are generally known to those skilled in the art. For example, chemicals or compounds generally having charged groups extending therefrom generally have or predicted to have a hydrophilic tendency. Similarly, chemicals or compounds having uncharged hydrocarbon groups extending therefrom are often, and can often predicted to be, hydrophobic. In this way, a chemical or compound having the same skeleton or basic structure, such as a thiophene can provide derivates which are hydrophilic and other derivates which are hydrophobic. It is the combination of the nature of the material on the rough metal-bonded surface of step (a), which allows the present invention to provide a method of coating a metallic article with the surface having a pre-determined wettability.

Currently, there is no agreed definition for a "superhydrophilic" surface, especially due to the difficulty of measuring the contact angle of such a surface. A contact angle of <10° or <5° has been suggested in the art.

In one embodiment of the present invention, the method provides a superhydrophobic surface on a metallic article having an at least part-metallic surface comprising a first metal, the first metal having a first reduction potential, comprising the steps of:

(a) contacting the first metal with an ionic metal solution, whose metal has a higher reduction potential (i.e. more positive or less negative reduction potential) than the first reduction potential, to provide a metal-coated surface;

(b) contacting the coated surface with a thiol material to provide a hydrophobic surface on the metallic article.

Strong bonding between the sulphur atom in the thiol material, and the metal which is deposited on the metallic article, creates a close packed self-assembled mono-layer, which gives the surface its hydrophobic nature, which nature can be characterized as superhydrophobic.

The metal of the ionic metal solution has a higher reduction potential than the reduction potential of the first metal of the metallic article. Such metals are known in the art, and two common examples are silver and gold, more particular silver (I) and gold (III) ions. Their ionic solutions can be provided by any number of known compounds, such as silver nitrate, silver sulphate, and various halogen-gold substances such as the chloroaurates.

Indeed, the coating of silver onto base metals such as zinc and copper is a procedure well known in the art, and can be carried out by the dipping of zinc or copper in silver nitrate solution.

The contacting of the metallic article with the second metal can be carried out by any known means including, but not limited to, dipping, brushing, spraying or the like. Dipping is simple and an easy method, wherein the metallic article is simply dipped into an ionic metal solution.

Because of the difference in reduction potential between the first metal of the metallic article and the metal of the ionic metal solution, there will generally be a redox reaction between the metals as is known in the art.

The thiol material is preferably a thiol solution: that is, any solution involving compound with a terminal SH group. Examples are the alkane thiols, such as preferably $C_{1-30+}$ straight or branched alkane thiols, preferably $C_{10-30+}$ alkane thiols, although many suitable aliphatic and aromatic thiol materials are also known.

The contacting of the pre-coated surface with the material in step (b) can be carried out in the same manner as the contacting of the metallic article with the second metal.

In another embodiment of the present invention, the metallic article to be coated can be cleaned prior to step (a). The cleaning of metallic articles with ketones such as acetone, alcohols such as absolute ethanol, etc, is well known in the art, generally to remove undesired materials from the surface of the metallic articles.

In a further embodiment of the present invention, cleaning of the metallic article to be coated could be carried out such that the pre-coating in step (a) is non-uniform. Such pre-coating may become uniform during step (a) but be initially hindered or slowed by the presence of dirty substances such as grease on the metallic article surface.

In another embodiment of the present invention, the metallic article to be coated is etched prior to step (a). Etching is a well known process, and is usually carried out by an acid, in order to create an etched surface.

Preferably, the metal of the second metal is deposited on the relevant surface of the metallic article in a uniform manner, although non-uniformed deposition may still be desired in certain circumstances, and is still within the scope of the present invention. Variation in the volume, depth, degree or uniformity of the second metal onto the surface of the metallic article can be varied by any number of means, such as the degree of cleaning or etching prior to step (a), the parameters of the contacting of second metal and the metallic article surface, or environmental factors.

The variables of deposition of a metal onto a surface are known in the art. For example, the contacting by dipping of a metallic article such as zinc or copper in a silver nitrate solution can be carried out in a number of minutes, the number of minutes usually depending upon the concentration of the solution. The higher the solution concentration, the less contacting time required for the same coating.

In another embodiment of the present invention, between steps (a) and (b), the metal surface of the metallic article is preferably washed and dried prior to contacting it with the next material. The drying can be carried out in many ways known in the art, including the provision of heating. Preferably, the drying is carried out by the use of a compressed gas such as compressed air, which is able to minimize physical engagement (for example to minimize dirt residue forming on the second metal), and to ensure a more uniform deposition layer of the second metal. If the coated surface is dried by physical contact with another material, such contact may affect the coated surface and therefore affect the final surface following step (b). This may be desired in certain circumstances.

In another preferred embodiment of the present invention, the tailored surface on the metallic article following step (b) is washed. Again, the washing may be carried out by any suitable material, which includes organic solvents such as dichloromethane.

In yet another embodiment of the present invention, the metallic article is in or is part of a substrate which is plastic, and the surface of the plastic substrate is treated to expose the embedded metallic article. For example, a plastic material may be roughened or exercised on its surface so as to expose a metallic article being metal powder in the plastic beneath its original surface.

According to a second aspect of the present invention, there is provided a coated metallic article having a surface with a pre-determined wettability whenever prepared by a method as herein defined.

The coated metallic article provided by the present invention may be an article in its own right, such as a powder, for example copper powder. Thus, the present invention provides a coated metal powder able to be subsequently used in one or more applications.

Such applications include for example using the powder to coat one or more other materials or substrates so as to provide a desired surface on such material or substrate. By way of example only, the powder could be applied or glued on to a surface, or heat melded into a plastic material so as to change the surface properties of that surface or material.

In a further embodiment of the present invention, a coated metallic article being a powder could be admixed with one or more textiles and/or plastic materials to form a textile and/or plastics composite material. For example, the powder could be admixed with a PVA material, to subsequently form the composite material into a desired shape, pattern or design which will inherently have a tailored surface as hereindescribed. In another example, the powder could be admixed with a textile to create an optionally flexible material with a pre-determined wettability such as superhydrophobicity. Thus, it could provide an improved waterproof material against rain.

The coated metallic article provided by the present invention could also be used in water, or another marine environment such as around sea-water or other moist air. Where the coated metallic article is superhydrophobic, it may reduce the ability of corrosive substances in water or carried in moist air to contact the metallic article, reducing corrosion or the rate of corrosion. For example, parts of a bridge, being underwater or above water, could be coated by the present invention, or with a powder provided by the present invention, to reduce corrosion.

Another example of the present invention is a planar microfluidic device having a coated metallic article as hereinbefore described, which can be patterned by mechanical removal of part of the surface coating, to provide areas or channels of different wettability. It could also be patterned by stamping to create physical channels which have the same wettability, such as superhydrophobicity, as surrounding parts.

Further examples of use of the present invention are conduits or pipes having an internal coated metallic article superhydrophobic surface, such that flowing water or water-based fluids have minimal contact with the container walls due to the air layer, reducing friction in turbulent flows.

In another embodiment of the present invention, an area, pattern or other design on the coating can be provided by the removal of part of the second metal coating from the surface of the metallic article. That is, by the use of scratching or other removal processes or means, a surface which has a complete coating thereon can be transfigured into a patterned coating to suit a particular use or arrangement.

In another embodiment of the present invention, it is possible to re-coat an area or areas of a metallic article surface which are not coated with a tailored surface, by application of the process of the present invention as hereinbefore described thereon. The metal of the ionic metal solution in step (a) will only apply itself to the surface of the metallic article that is made available, rather than any part of the surface which is already coated with the material of step (b). Thus, if the metallic article is damaged or in need of repair, or otherwise to coated again, can be coated using the present invention.

Examples and embodiments of the present invention will now be described by way of example only, and with reference to the accompanying drawings in which:

FIGS. 1*a* and 1*b* are face and side views respectively of a copper sheet with a silver and HDFT coating;

FIGS. 2*a-d* are SEM images of a) silver on etched zinc, b) gold on etched zinc, c) silver on copper, and d) gold on copper;

FIGS. 3*a-d* are four photographs of contact angle measurements between a water droplet and surfaces of the present invention;

Figures 1A, 1B:
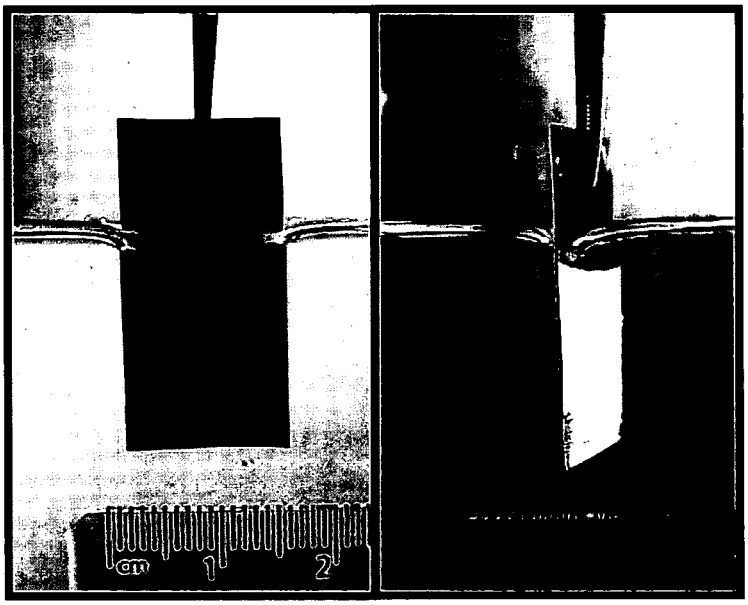

Referring to the drawings, FIGS. 1*a* and 1*b* show a silver coating on copper with a HDFT polyfluoroalkyl mono-layer provided by Example 1 hereinafter described. Once the surfaces have been prepared, they have a matt black appearance, however when they are slowly placed vertically into water and viewed past a critical angle they appear as perfect silver mirrors. The absolute reflectivity was measured at an incidence angle of 27.5° from the parallel and found to be 96%±4%. The critical angle was measured at 48.6°±0.9° from the perpendicular, the predicted angle for a complete air layer formed between the surface and the liquid is 48.626°. The high absolute reflectivity and the good agreement between measured and predicted critical angles both indicate that the mirror like appearance is due to an air layer between the water and hydrophobic surface which arises due to complete non-wetting of the surface i.e. a contact angle of ~180°.

Not only does this optical property allow easy identification of a perfect hydrophobic surface but it also highlights any damage to such a surface e.g. from marks made by implements such as forceps during handling. Damage to the surfaces can also be detected by the behaviour of water drops deposited onto them. As the surfaces are superhydrophobic, any needle tip used will be more hydrophilic than them so that drops cannot simply be dispensed by bringing them into contact with the surface. In fact, water must be dropped onto the surfaces, but as water drops on these surfaces will general spontaneously roll off (especially where the roll off angle is <1°), then if a drop does come to rest, it is most likely pinned to a small imperfection in the surface.

Figure 2B:
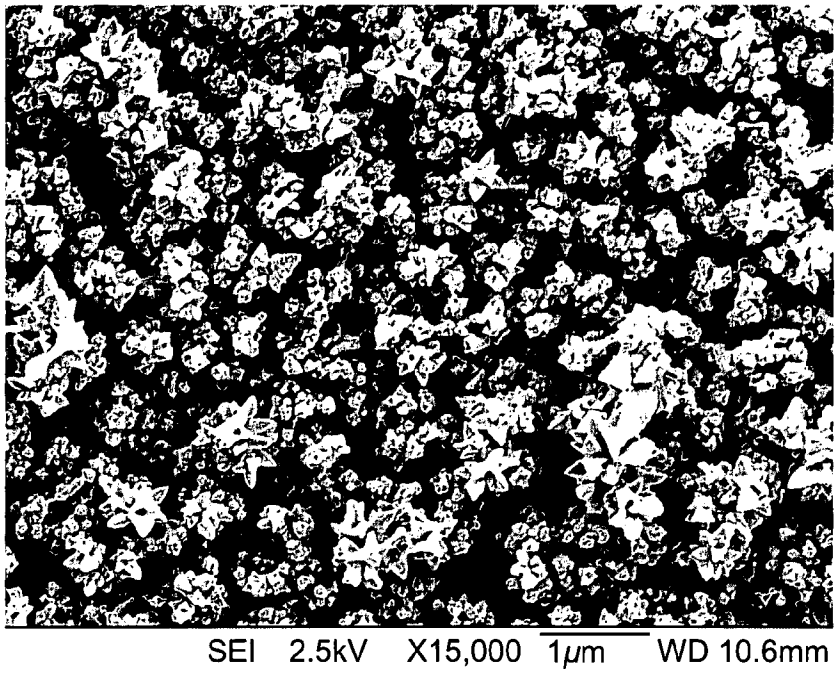
Figure 2A:
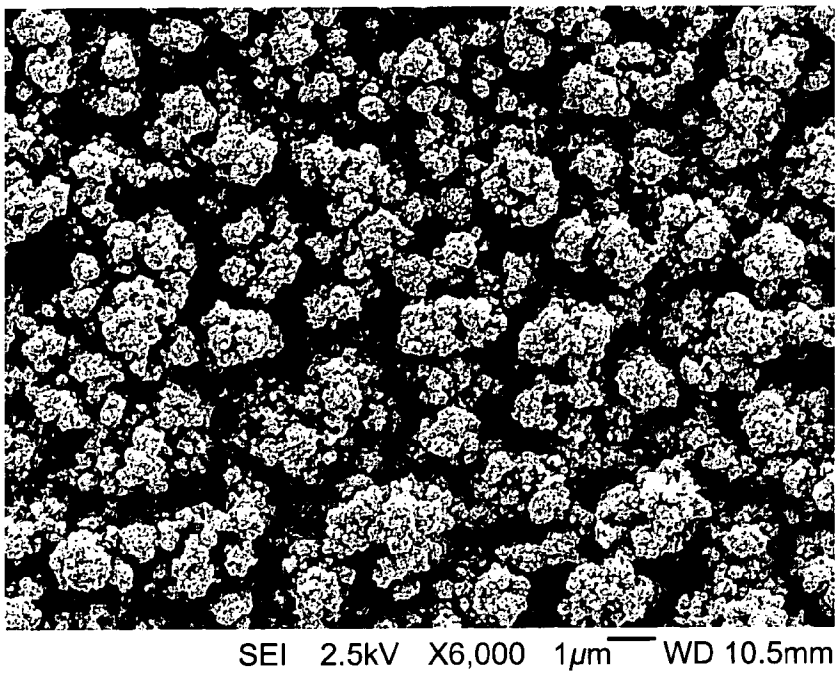
Figure 2D:
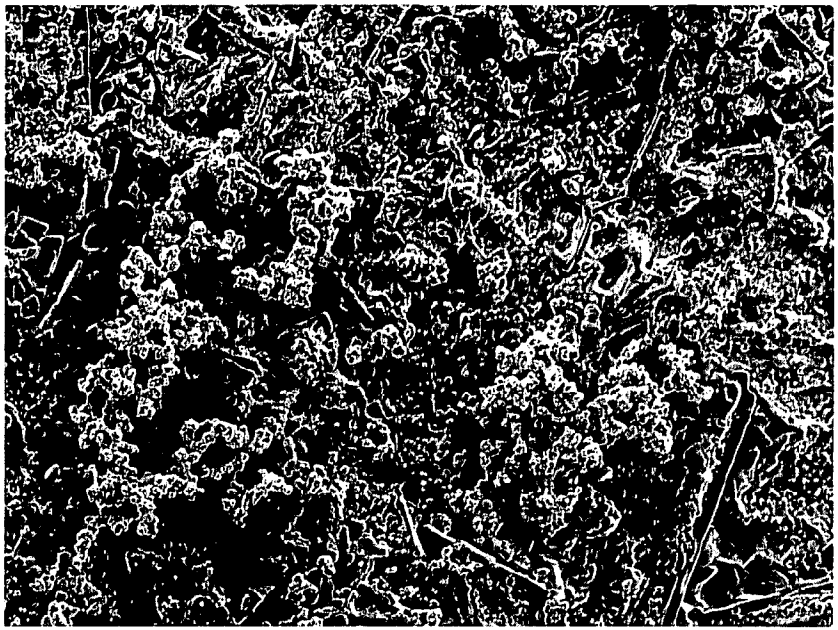

The SEM images shown in FIGS. 2*a-d* are four variations of silver and gold deposited on zinc, and silver and gold deposited on copper, respectively. Considering these SEM images, the surfaces prepared on etched zinc show much taller structures. The silver on zinc deposition structure in FIG. 2*a* is made up of "stalks" ranging in diameter from 0.75 to 2 μm. Each of these "stalks" has smaller particles thereon which are approximately 100 to 200 nm; this is thus a double roughness scheme which gives superhydrophobicity.

The gold on etched zinc in FIG. 2*b* is made of much more angular sections that combine to give flower-like structures with petals. These petals range is size from 60 to 200 nm in width, and the flowers from 200 to 700 nm.

The silver on copper (FIG. 2*c*) gives a similar structure to that of silver on zinc, although the overall structure seems less well developed. In this structure, the stalks have diameters of 200 to 300 nm, and the particles on the stalks ranging in size from 50 to 100 nm. The gold on copper (FIG. 2*d*) is different, with the structure consisting of some particles fused together into a structure and smooth lava-like metal. There are not the sharp edged flower-like structures seen with gold on etched zinc. The lava-like flows make up the majority of the surface.

The exact nature of the surface morphology in not critical, as after treatment with HDFT, all the surfaces shown in FIGS. 2*a-d* were found to be superhydrophobic, showing the 'silver mirror' past the critical angle mentioned hereinabove.

Figure 2C:
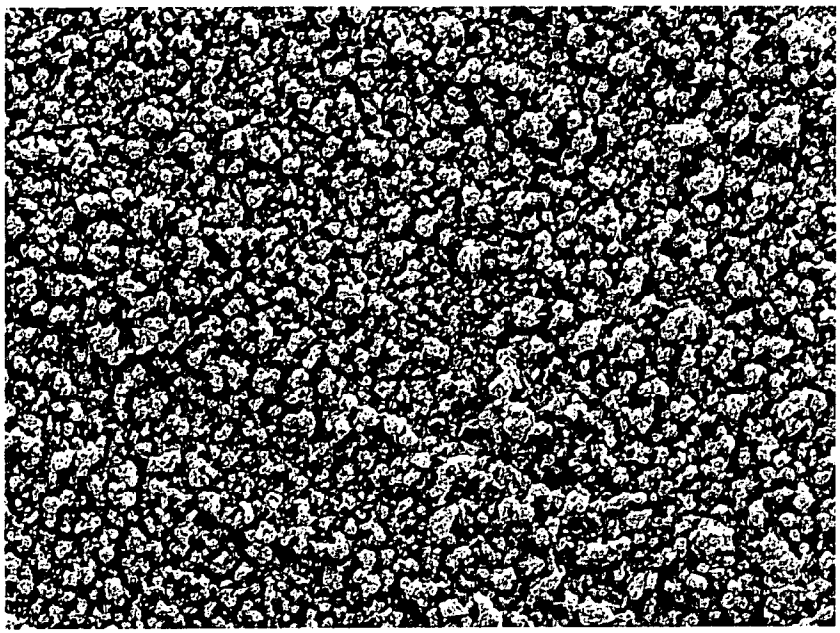
Figure 5:
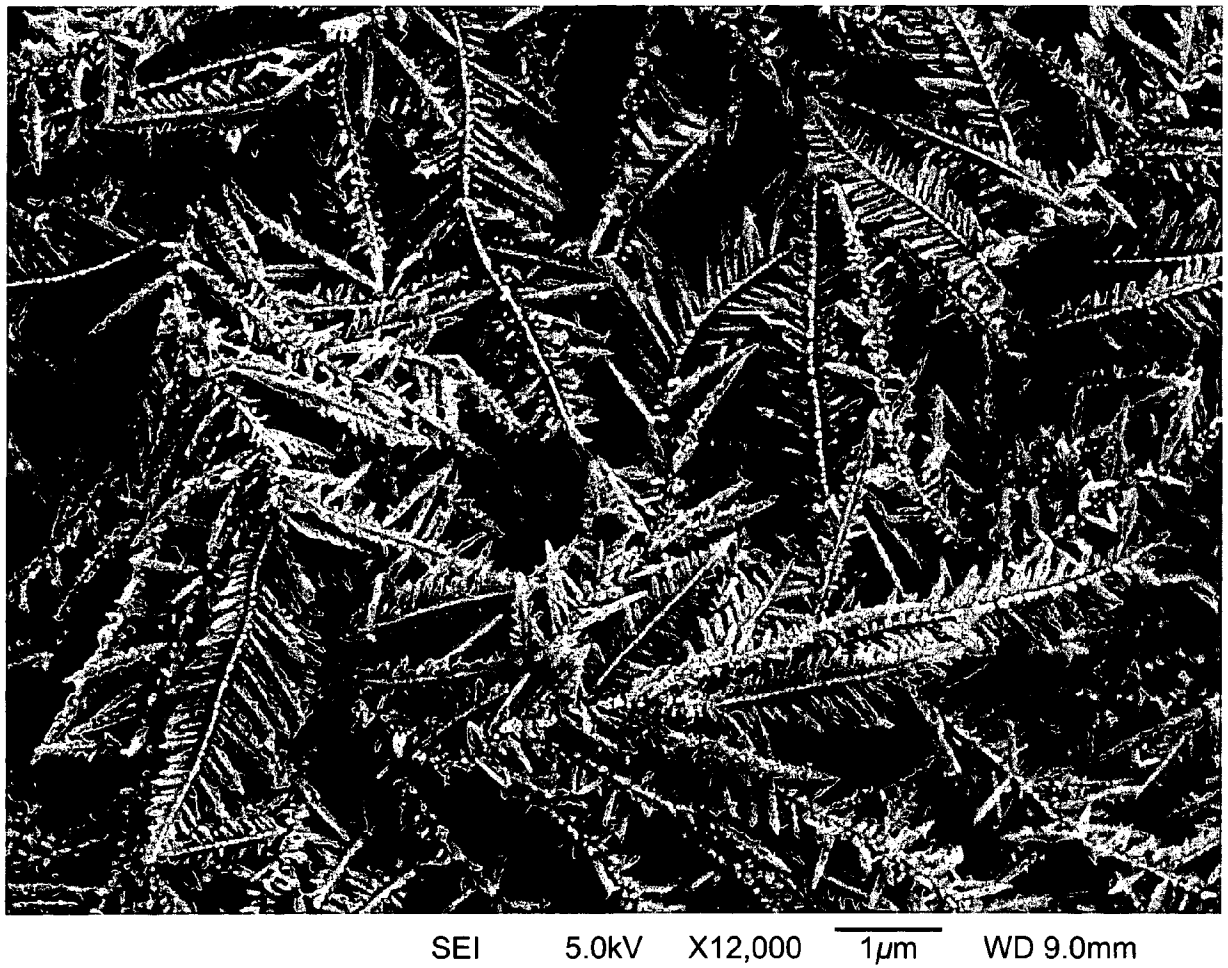
FIG. 5 is an SEM image of a Cu—Ag-HDFT surface with a longer deposition time in step (a)

As another example, FIG. 5 shows a copper surface coated with silver and HDFT, having a longer treatment time for the silver deposition than the silver deposition time for the surfaces shown in FIGS. 2*a* and 2*c*. FIG. 5 shows a surface structure having a double roughness based on a 'fern-leaf' type structure. This structure illustrates another double roughness' structure achieved by diffusion limited aggregation processes.

One use of the high reflectivity of the interface between the aqueous and hydrophobic surfaces is to coat the inside of a small bore tube or pipe to form a waveguide. A dilute solution can be placed inside the pipe and it effectively acts as a fibre optic cable but with a liquid core encased in an air sheath. A light beam can then be sent directly down the guide and spectroscopy of weak solutions carried out.

These surfaces can also be used in sensing applications, the self-assembled monolayer providing a simple route for the introduction of a wide range of functionality. This combined functionality and perfect hydrophobicity can be incorporated into lab-on-a-chip applications. Flow cells until now have generally been made of a plastic, however changing them to a metal base will allow these perfectly hydrophobic surfaces to be utilised in this application for example by using part-coated or featured surfaces to guide liquids in hydrophilic channels bounded by hydrophobic walls.

In addition, cavity enhanced Raman spectroscopy relies on a drop of fluid being spherical to allow internal reflections to occur which increases any weak Raman signal. Drops on these surfaces, provided they are small enough to negate the effect of gravity, will allow this particular Raman technique to develop further.

The drying of drops is also interesting as these surfaces will allow the study of mechanical behaviours of complex fluids as they dry, e.g. colloid-polymer suspensions. This has, until now, relied upon the use of concave hot plates to levitate droplets on thin layers of their own vapour, the Leidenfrost effect.

Figure 4:
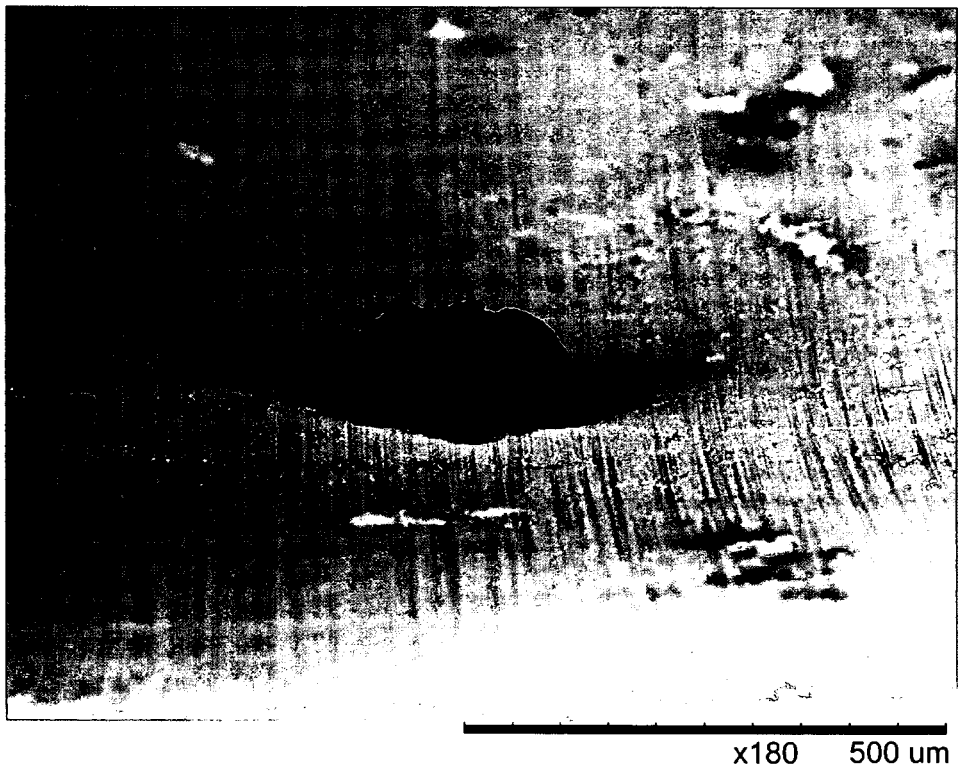
FIG. 4 is an SEM image of a salt deposit from an evaporated water drop.

Moreover, as the surface is perfectly hydrophobic, the drying of solutions will not result in the "coffee-ring" effect seen on other media, where the drop edge becomes pinned as it dries leaving a ring of deposited material. FIG. 4 shows a SEM image of a 150 μm NaCl single and central deposit dried down from a $1\times10^{-3}$ salt solution droplet. FIG. 4 clearly shows that the droplet has dried towards the centre to leave the salt deposited as a central deposit, rather than being deposited as a ring. Microscopic analysis, Raman or infrared spectroscopy, can then be carried out on these dried deposits to gain an insight into the whole mixture, thus preventing separations that can occur in the drying of biological samples in particular.

Example 1

99.95+% zinc foil, 0.25 mm thick (Goodfellow) was cut to the desired size. The metal was washed in acetone, puriss grade (Riedel-de-Haën) and ethanol, absolute ACS grade (J. T. Baker) and dried. It was then placed in a 4M hydrochloric acid solution, 8.21 ml 37-38% (max 5 ppb Hg) HCl (J. T. Baker) was added to 16.79 ml deionised water to give a 25 ml solution. The metal was removed from the acid solution after 60 seconds and washed with deionised water and dried. A 0.01M silver nitrate solution was prepared, 0.0169 g in 10 ml deionised water, silver nitrate—AnalaR (99.8%) (BDH Chemicals Ltd.). The zinc was placed into this solution and held vertically until a uniform black coating was deposited onto the surface in approximately 30 seconds. The exact timing will depend on local conditions, for example the exact concentration, as 10 ml of solution will treat more than one surface and temperature. When removed, the surface can be dried in a stream of compressed air and inspected, and if there are still areas of bare metal showing the surface can be replaced into the silver nitrate solution and then withdrawn and dried until the surface is a uniform matt black.

Once dry the surface was placed into a $1\times10^{-3}$ M solution of 3,3,4,4,5,5,6,6,7,7,8,8,9,9,10,10,10-Heptadecafluoro-1-decanethiol (HDFT), ≥99.0% (Fluka). 14.5 μl Heptadecanfluoro-1-decanethiol was added to 50 ml dichloromethane, GPR (BIOS Europe). The surface was left in this solution for >1 minute (the self-assembled thiol monolayer is formed very quickly, within two dips, but it is good practice to allow the surface species to fully stabilize.) When removed, it was washed in clean dichloromethane, and as soon as it was removed from the clean dichloromethane solvent, it was placed under a stream of compressed air.

This surface is superhydrophobic; that is, water droplets deposited on it roll off when they are inclined at >1°. Photographically-measured contact angles are typically 173°±2° (see FIG. 3*b*) as determined by curve fitting to images of deposited drops. The problems associated with measuring very high contact angles are well-known, so the test used was that of Gao and McCarthy, (Journal of the American Chemical Society, 2006, vol. 128, 9052-53), which involves looking for signs of adhesion when a treated surface is pulled away from a drop of liquid. The surfaces also passed this test for "180°" contact angle materials.

The above is one method to create silver on zinc surfaces. The concentrations used are 'standard' such that they can be easily varied for the treatment of many surfaces (noting that, for example, 10 ml of 0.01 M silver nitrate solution can treat approximately seven pieces of metal, 1.5×2 cm, while the Heptadecafluoro-1-decanethiol solution can treat >10 surfaces). Concentrations can also be reduced but the time it takes for the deposition layer to form will be affected.

Example 2

Figure 3A:
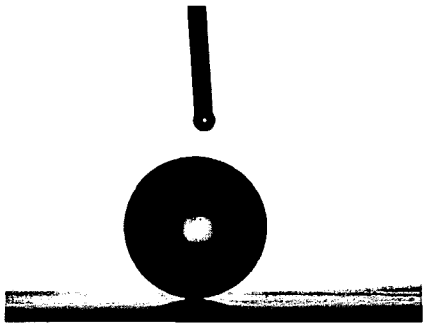
Figure 3B:
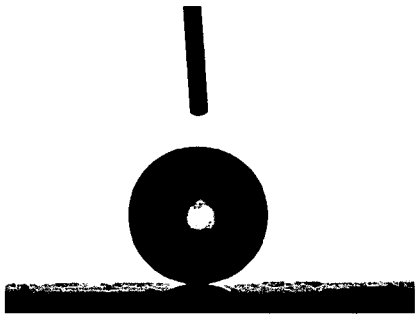

99.9% Copper foil, 0.25 mm thick (Goodfellow) was used as the base metal. Gold instead of silver was deposited. A $3.83\times10^{-3}$ M solution was prepared, 5 μl Hydrogen tetrachloroaurate (III) hydrate, p.a. (Acros Organics) was dissolved in 15 ml deionised water. 1-Decanethiol, 96% (Alfa Aesar) was used as the monolayer species, and a $1\times10^{-3}$ M solution was prepared, 10.5 μl of 1-decanethiol was dissolved in 50 ml dichloromethane GPR (BIOS Europe). This created another superhydrophobic surface which passed Gao's test for "180°" contact angle materials as shown in FIG. 3*a*

Example 3

For superhydrophilic activity, a solution of 6-Mercapto-1-hexanol (6 MH1), purum ≥97% (Fluka) can be used. A $1\times10^{-3}$ M solution was prepared, 6.8 μl dissolved in 50 ml deionized water. Compressed nitrogen can be used instead of compressed air during the drying stages of the method.

The materials in the above Examples are interchangeable in the methods described above. In changing the reagents, the time taken for the metal deposition may vary. For example, 4M HCl on copper can clean off any surface impurities, whilst the same strength acid would etch another metal such as zinc.

Example 4

40 g of three different copper powders (having general particles sizes 475 μm, <75 μm and <10 μm, all available from Aldrich) was weighed out and washed with 0.5% $HNO_3$, filtered and washed with deionized water. 70 mls of 0.02M $AgNO_3$ was added to the flask and the powder shaken over several minutes. The powder was filtered and washed before being placed in an oven at 70° C. until dry. Then 100 ml of a 0.1M decanethiol solution in ethanol was added on top of the powder and the whole shaken. This was left overnight before being filtered and washed with clean ethanol. It was then placed back in the oven until dry.

Figure 3C:
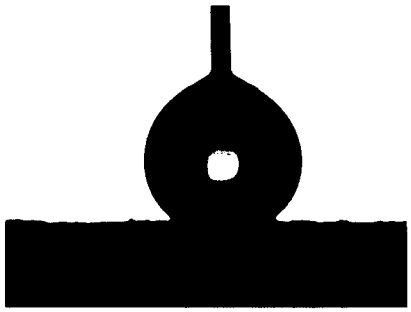
Figure 3D:
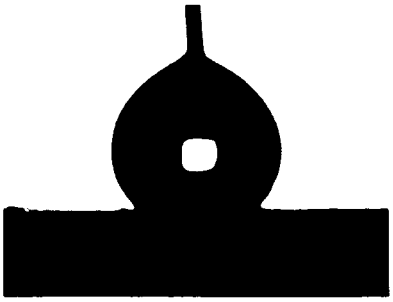

The contact angle for use of the <75 μm powder glued onto a flat surface is shown in FIG. 3*c*, and is 157°±3°. The contact angle for use of the <10 μm powder glued onto a flat surface is shown in FIG. 3*d* and is 153°±2°.

Figure 6:
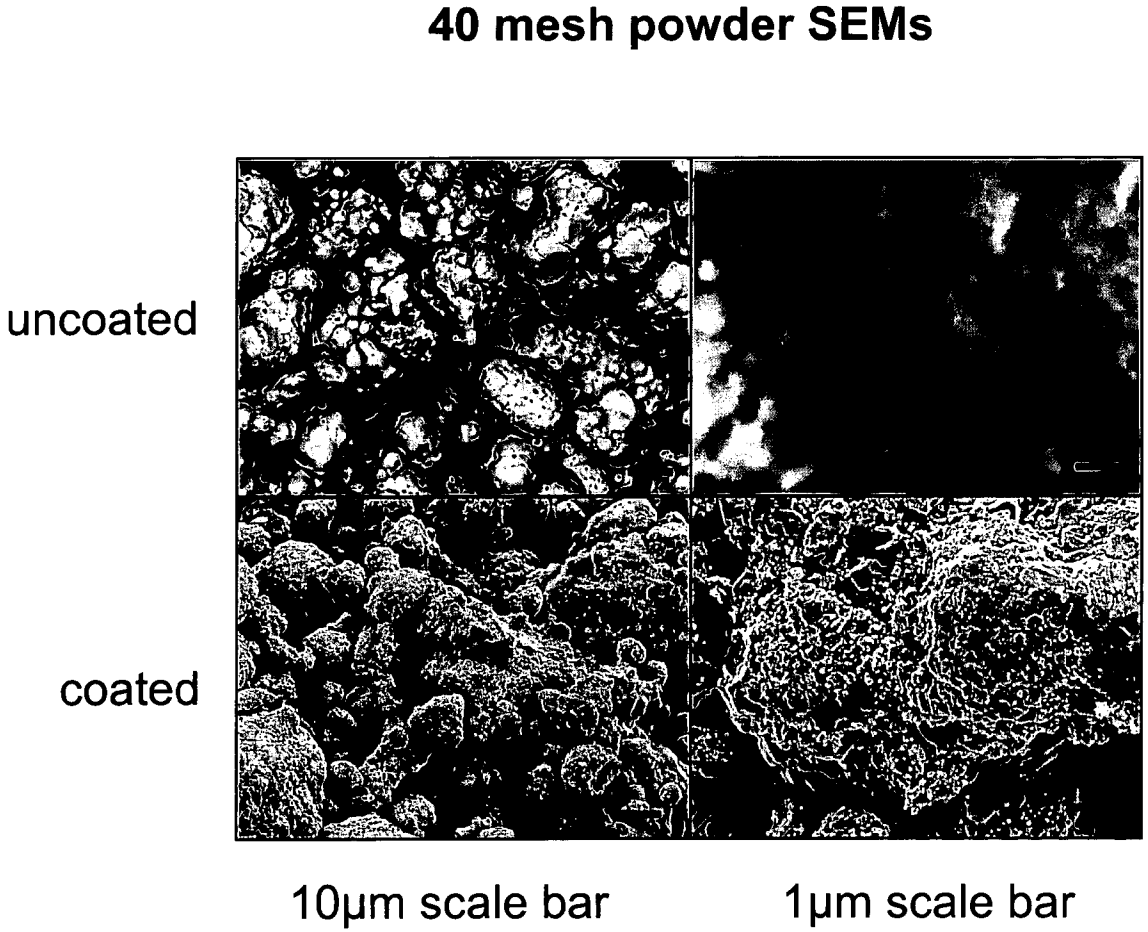
FIG. 6 shows four SEM images of two comparisons of an uncoated powder and then a coated powder according to another embodiment of the present invention.

FIG. 6 shows two sets of comparison SEM images at different magnifications of a 40 mesh powder. The powder is firstly shown 'as is', i.e. 'uncoated', and then shown following being coated as in Example 4 hereinbefore. The coated SEM images show the roughness created on the surface of the powder particles by the method of the present invention.

The skilled person in the art is aware that the exact concentrations, weight of powder, size of powder and treatment times can be varied over many ranges of combinations.

Example 5

Copper Plating

To provide a metallic article as copper plating, the substrate is placed in a 0.05M $CuSO_4$ solution and attached to a power pack with a piece of copper as the other electrode. For a substrate such as titanium, 2V is applied over 90 minutes before being turned off and the titanium removed; it is now copper coated.

This surface can then be cleaned in 4M HCl and rinsed, then placed in a 0.02M $AgNO_3$ solution for several minutes, washed and dried and finally placed in a 0.001M HDFT (heptadecafluoro-1-decanethiol) solution for an hour.

The skilled person in the art is aware that the exact concentration of the plating solution, voltage, time and experimental parameters for the subsequent electroless deposition process can be varied over an almost infinite range of combinations. Thus, examples of metallic articles having a surface with a tailored or pre-determined wettability that have been prepared in accordance with the present invention include those using:

1. Zinc, silver and 3,3,4,4,5,5,6,6,7,7,8,8,9,9,10,10,10-heptadecafluoro-1-decanethiol (fluoro-thiol).
2. Zinc, gold and fluoro-thiol.
3. Copper, silver and fluoro-thiol.
4. Copper, gold and fluoro-thiol.
5. Zinc, silver and 1-decanethiol.
6. Zinc, gold and 1-decanethiol.
7. Copper, silver and 1-decanethiol.
8. Copper, gold and 1-decanethiol.
9. Zinc, silver and 6-mercapto-1-hexanol.
10. Zinc, silver and pentanethiol.
11. Zinc, silver and hexanethiol.
12. Zinc, silver and octanethiol.
13. Zinc, silver and hexadecanethiol.
14. Zinc, silver and cyclohexanethiol.
15. Zinc, silver and cyclopentanethiol.
16. Zinc, silver and 16-mercaptohexadecanoic acid.
17. Zinc, silver and 3-mercaptopropionic acid.
18. Zinc, silver and 4-trifluoromethylthiophenol.
19. Brass, silver and fluoro-thiol.
20. Zinc, silver and 2-propylamine.
21. Zinc, silver and 2-mercaptopyridine.
22. Zinc, silver and benzonitrile.
23. Zinc, silver and cyclohexylisocyanide.
24. Zinc, silver and diisopropylamine.
25. Zinc, silver and thiophene.
26. Zinc, silver and 2,3,4,5,6-pentafluorobenzonitrile.
27. Zinc, silver and 2,3,4,5,6-pentafluoraniline.
28. Zinc, silver and 3,4,5-trifluorobenzonitrile.
29. Zinc, silver and 2,3,4,5,6-pentafluorophenyldiphenylphospine.
30. Zinc, silver and tris(4-fluorophenyl)phosphine.
31. Zinc, silver and tris(2,3,4,5,6-pentafluorophenyl)phosphine Further details of some of the above combinations are shown in Table 2 hereinafter.

The sources of metal ions for these compounds were: silver=silver nitrate; and gold=hydrogen tetrachloroaurate (III) hydrate.

Further examples include the following metals, which were dipped into silver nitrate to confirm deposition occurred for step (a) of the process of the present invention.

1. Nickel
2. Tin
3. Iron
4. Aluminium

The surface of zinc, silver and fluoro-thiol was also created starting from silver sulphate ($Ag_2SO_4$), to confirm that the present invention can be carried out with various sources of silver.

Surfaces 1, 5 & 9 above were tested with several solvents. For surface 9, everything wetted the surface. Details for surfaces 1 & 5 are set out in the Table 1 below.

TABLE 1

| | Fluoro-thiol Activity | | | Decanethiol Activity | | |
|---|---|---|---|---|---|---|
| Solvent | SH | H | W | SH | H | W |
| Water | ◘ | | | ◘ | | |
| n-hexane | | | ◘ | | | ◘ |
| cyclohexane | | ◘ | | | | ◘ |
| n-pentane | | | ◘ | | | ◘ |
| benzene | | ◘ | | | | ◘ |
| ethanol | | | ◘ | | | ◘ |
| diethyl ether | | | ◘ | | | ◘ |
| toluene | | ◘ | | | | ◘ |
| ethyl acetate | | | ◘ | | | ◘ |
| pyridine | | ◘ | | | | ◘ |
| ethylene glycol | | ◘ | | | ◘ | |
| Dimethyl sulphoxide | ◘ | | | ◘ | | |
| Triethylene glycol dimethyl ether | ◘ | | | | | ◘ |
| Tetraethylene glycol dimethyl ether | ◘ | | | | | ◘ |

SH = superhydrophobic/completely non-wetting, i.e. a silver mirror is seen when fully submerged and viewed past the critical angle. Contact angle >150°;
H = hydrophobic i.e. a hemisphere is observed on the surface. Contact angle approximately 90°;
W = superhydrophilic/fully wetting. Contact angle <5°.

It is clear from Table 1 that the wettablility is determined by the nature of the modifying layer as well as the metals. For example triethylene glycol dimethyl ether completely wets a surface treated by alkyl thiol but is completely non-wetting when the perfluoro thiol is used instead.

The accompanying Table 2 shows the contact angle values of various surfaces for particular metal surfaces per se, and then the same surfaces with various combinations of constituents and/or timings and/or concentrations according to the present invention. The range of contact angle values in the table show surfaces provided with a wettability between superhydrophobic and superhydrophilic i.e. tailored wettability between the two extremes. The table also shows examples of pre-roughening metallic surfaces by wet acid etching them, and then gold coating the roughened surfaces before thiol treatment. These again show tailored wettability as the wettability can change depending on preparation method.

The first six entries in Table 2 show the contact angle for six example metals. Thereafter, different variations of metal, etching, second metal and material thereon to provide the relevant final or top surface are shown, along with the contact angle of each such surface. For example, copper with a second metal of silver and a 6-mercapto-1-hexanol (6 MH1) material provides a superhydrophilic surface, whilst copper with a pre-etching with hydrochloric acid, a second metal of silver and a HDFT material, provides a contact angle that could be defined as superhydrophobic.

Similarly, <75 um copper powder has a contact angle of 129°, whereas with pre-etching the same powder with nitric acid, and adding a second metal of silver and a decanethiol layer thereon, provides a surface with a contact angle of 152°. A range of thiol-based materials such as alkylthiols, aryithiols and mercapto acids again provide variation in contact angle. Table 2 then shows variation in contact angle based on variation in etching time for various acids and metallic surfaces with the same second metal and top material layer.

Thus, it is possible by the present invention to consider a desired contact angle and starting with a first metal, provide suitable etching time and acid (if required), second metal, and top material layer, to provide a surface with pre-determined or tailored wettability. Table 2 relates to contact angle with water, but the skilled person in the art is aware of using the same criteria with other liquids.

TABLE 2

| First metal | Etching Time/acid | Second metal | Top material | Contact Angle (°) | S.D. |
|---|---|---|---|---|---|
| Zinc | — | — | — | 93.431 | 1.916 |
| Copper | — | — | — | 96.896 | 0.491 |
| Silver | — | — | — | 73.459 | 3.156 |
| Gold | — | — | — | 76.282 | 1.656 |
| Titanium | — | — | — | 83.570 | 1.382 |
| Iron | — | — | — | 82.253 | 2.018 |
| Zinc | 2 min 4M HCl | Ag | 6MH1 | 25.965 | 3.287 |
| Copper | — | Ag | 6MH1 | 2.767 | 0.842 |
| Zinc | 2 min 4M HCl | Au | HDFT | 159.796 | 1.032 |
| Zinc | 2 min 4M HCl | Ag | HDFT | 173.260 | 0.837 |
| Copper | — | Ag | HDFT | 172.903 | 1.490 |
| <75 um Cu powder | — | — | — | 129.244 | 1.982 |
| <75 um Cu powder | 0.5% $HNO_3$ | Ag | decanethiol | 152.690 | 1.209 |
| <10 um Cu powder | — | — | — | 117.484 | 0.730 |
| <10 um Cu powder | 0.5% $HNO_3$ | Ag | decanethiol | 152.572 | 2.372 |
| Zinc | 2 min 4M HCl | Ag | pentanethiol | 154.894 | 0.634 |
| Zinc | 2 min 4M HCl | Ag | hexanethiol | 155.181 | 0.744 |
| Zinc | 2 min 4M HCl | Ag | octanethiol | 157.137 | 1.557 |
| Zinc | 2 min 4M HCl | Ag | decanethiol | 157.397 | 0.651 |
| Zinc | 2 min 4M HCl | Ag | hexadecane thiol | 161.500 | 1.398 |
| Zinc | 2 min 4M HCl | Ag | benzenethiol | 133.529 | 1.916 |
| Zinc | 2 min 4M HCl | Ag | pentafluoro thiophenol | 127.252 | 1.160 |
| Zinc | 2 min 4M HCl | Ag | 4-methyl benzenethiol | 134.792 | 2.211 |
| Zinc | 2 min 4M HCl | Ag | 4-trifluoro methylthio phenol | 150.751 | 2.140 |
| Zinc | 2 min 4M HCl | Ag | 2-methyl benzenethiol | 133.351 | 2.736 |
| Zinc | 2 min 4M HCl | Ag | 3-methyl benzenethiol | 125.942 | 1.230 |
| Zinc | 2 min 4M HCl | Ag | 4-methoxy benzenethiol | 128.692 | 4.686 |
| Zinc | 2 min 4M HCl | Ag | cyclohexane thiol | 156.010 | 1.009 |
| Zinc | 2 min 4M HCl | Ag | cyclopentane thiol | 156.450 | 1.276 |
| Zinc | 2 min 4M HCl | Ag | 16-mercapto hexadecanoic acid | 159.560 | 1.027 |
| Zinc | 2 min 4M HCl | Ag | 3-mercapto propionic acid | unmeasureably small | |

TABLE 2-continued

| First metal | Etching Time/acid | Second metal | Top material | Contact Angle (°) | S.D. |
|---|---|---|---|---|---|
| Zinc | 1 min 4M HCl | sputtered Au | HDFT | 139.368 | 2.928 |
| Zinc | 2 min 4M HCl | " | HDFT | 142.162 | 2.540 |
| Zinc | 3 min 4M HCl | " | HDFT | 144.676 | 0.921 |
| Zinc | 4 min 4M HCl | " | HDFT | 146.997 | 1.261 |
| Zinc | 8 min 4M HCl | " | HDFT | 148.608 | 2.608 |
| Zinc | 12 min 4M HCl | " | HDFT | 127.802 | 1.546 |
| Zinc | 16 min 4M HCl | " | HDFT | 123.813 | 1.211 |
| Titanium | 10 sec 10% HF | sputtered Au | HDFT | 118.125 | 3.982 |
| Titanium | 20 sec HF | " | HDFT | 116.575 | 1.207 |
| Titanium | 30 sec HF | " | HDFT | 117.471 | 1.832 |
| Titanium | 60 sec HF | " | HDFT | 135.483 | 1.503 |
| Titanium | 2 min HF | " | HDFT | 115.299 | 1.251 |
| Titanium | 4 min HF | " | HDFT | 114.166 | 1.055 |
| Titanium | 6 min HF | " | HDFT | 111.819 | 0.771 |
| Iron | 1 min 37-38% HCl | sputtered Au | HDFT | 124.234 | 1.758 |
| Iron | 2 m HCl | " | HDFT | 126.435 | 3.722 |
| Iron | 3 min HCl | " | HDFT | 139.802 | 2.238 |
| Iron | 4 min HCl | " | HDFT | 140.682 | 1.295 |
| Iron | 8 min HCl | " | HDFT | 122.878 | 1.166 |
| Iron | 5 min 70% HNO3 | " | HDFT | 114.874 | 2.770 |
| Iron | 10 min HNO3 | " | HDFT | 103.498 | 1.276 |
| Iron | 15 min HNO3 | " | HDFT | 94.744 | 2.722 |
| Iron | 20 min HNO3 | " | HDFT | 109.961 | 1.967 |

The invention claimed is:

1. A method of coating a metallic article, at least a part of a surface of the metallic article comprising a first metal, the method at least comprising the steps of:

(a) coating by a spontaneous redox reaction at least a part of the metallic article with a layer of a second metal to provide a metal-metal bonded surface, wherein the metal-metal bonded surface is a first metal-second metal bonded surface, wherein the redox reaction includes an oxidation reaction of the first metal and a reduction reaction to form the second metal; and (b) contacting the metal-metal bonded surface of step (a) with a hydrophobic material, wherein the metal-metal bonded surface has a double roughness having a plurality of first roughness structures on a microscale between 100 nm and 100 μm, and wherein a second roughness structure is on each first roughness structure, the second roughness structure being nanoscale extensions or protuberances of less than 30% of the size of the first roughness structure, such that the method provides a superhydrophobic surface having a contact angle with water of greater than 150°.

2. The method as claimed in claim 1, wherein the first metal comprises at least one of iron, zinc, copper, tin, tungsten, titanium, nickel, steel, brass, bronze, nitinol, an alloy of iron, an alloy of zinc, an alloy of copper, an alloy of tin, an alloy of tungsten, an alloy of titanium, an alloy of nickel, or an alloy of aluminum.

3. The method as claimed in claim 1, wherein the surface of the metallic article is wholly or substantially metallic.

4. The method as claimed in claim 1, wherein the metallic article is a powder.

5. The method as claimed in claim 4, wherein the metallic article is admixed or embedded in a non-metallic article.

6. The method as claimed in claim 5, wherein the non-metallic article is a plastic.

7. The method as claimed in claim 1, wherein the metallic article is a substrate at least partly pre-coated prior to step (a) with a third metal.

8. The method as claimed in claim 7, wherein the third metal comprises at least one of iron, zinc, copper, tin, tungsten, titanium, nickel, aluminum, steel, brass, bronze, nitinol, an alloy of iron, an alloy of zinc, an alloy of copper, an alloy of tin, an alloy of tungsten, an alloy of titanium, an alloy of nickel, or an alloy of aluminum.

9. The method as claimed in claim 8, wherein the third metal is copper.

10. The method as claimed in claim 7, wherein the third metal is pre-coated onto the metallic article by a spontaneous redox reaction, electrochemical deposition, immersion or by sputtering.

11. The method as claimed in claim 7, wherein the substrate is wholly or substantially metallic.

12. The method as claimed in claim 7, wherein the substrate is selected from the group consisting of a wholly non-metallic material, a substantially non-metallic material, a ceramic material and silicon.

13. The method as claimed in claim 7, wherein the second metal is silver, gold, or a combination of both.

14. The method as claimed in claim 1, wherein at least the part of the metallic article to be coated is roughened prior to step (a).

15. The method as claimed in claim 1, wherein the hydrophobic material of step (b) comprises at least one of thiols, nitriles, alkylamines, arylamines, phosphines, pyridines, pyrroles thiophenes or combinations thereof.

16. The method as claimed in claim 15, wherein the hydrophobic material is a thiol, and the second metal is silver or gold.

17. The method as claimed in claim 1, wherein step (b) is carried out at ambient temperature and pressure.

* * * * *